US006039481A

United States Patent [19]

Ham

[11] Patent Number: 6,039,481

[45] Date of Patent: Mar. 21, 2000

[54] PAPER WIDTH DETECTING APPARATUS AND METHOD FOR INK-JET PRINTER

[75] Inventor: Sang-Man Ham, Suwon, Rep. of Korea

[73] Assignee: SamSung Electronics Co., Ltd., Kyungki-do, Rep. of Korea

[21] Appl. No.: 09/224,956

[22] Filed: Jan. 4, 1999

Related U.S. Application Data

[63] Continuation-in-part of application No. 09/001,468, Dec. 31, 1997, abandoned.

[30] Foreign Application Priority Data

Dec. 31, 1996 [KR] Rep. of Korea ..... 96/80906

[51] Int. Cl.[7] ..... B41J 29/18

[52] U.S. Cl. ..... 400/708; 400/711; 400/342; 400/642

[58] Field of Search ..... 400/703, 706, 400/707.1, 708, 711, 630, 633, 633.2, 642, 705, 705.1, 342, 279, 709

[56] References Cited

U.S. PATENT DOCUMENTS

| | | | |
|---|---|---|---|
| 4,457,507 | 7/1984 | Ishikawa et al. | 271/121 |
| 4,591,871 | 5/1986 | Ohta | 346/49 |
| 4,734,868 | 3/1988 | DeLacy | 364/519 |
| 4,786,042 | 11/1988 | Stemmle | 271/9 |
| 5,127,752 | 7/1992 | Courtney | 400/342 |
| 5,135,316 | 8/1992 | Kuramitsu et al. | 400/57 |
| 5,255,987 | 10/1993 | Mizuno et al. | 400/61 |
| 5,397,192 | 3/1995 | Khormaee | 400/708 |

*Primary Examiner*—John S. Hilten
*Assistant Examiner*—Dave A. Ghatt
*Attorney, Agent, or Firm*—Robert E. Bushnell, Esq.

[57] ABSTRACT

A paper width detecting apparatus and method for an inkjet printer includes a right paper support integrally formed with a right home position detecting rib; a paper feeding portion for receiving paper sheets and supplying them for printing with the left paper guide movable left and right to tightly fix the paper at the reference of the right paper support; a paper feeding roller for supplying the paper sheets received from the paper feeding portion; a carrier that reciprocates for printing on the paper sheets supplied through the rotation of the paper feeding roller; a photosensor for detecting a light signal output from a light emitting device mounted on the left paper end detecting rib to determine a paper width.

16 Claims, 8 Drawing Sheets

PAPER WIDTH DETECTING APPARATUS AND METHOD FOR INK-JET PRINTER

CROSS-REFERENCE TO RELATED APPLICATIONS

This application claims priority under 35 U.S.C. §120 from and is a continuation-in-part of Applicant's U.S. application Ser. No. 09/001,468, filed in the U.S. Patent & Trademark Office on the 31st day of December 1997, now abandoned.

CLAIM OF PRIORITY

This application makes reference to, incorporates the same herein, and claims all benefits accruing under 35 U.S.C. §119 and from my application entitled PAPER WIDTH DETECTION APPARATUS AND METHOD FOR INK-JET PRINTER earlier filed in the Korean Industrial Property Office on the 31st day of December 1996, and there duly assigned Ser. No. 96-80906 by that office.

FIELD OF THE INVENTION

The present invention relates to a paper width detecting apparatus and method for an inkjet printer and more particularly, to a paper width apparatus and method for an inkjet printer in which a photosensor is attached to a carrier to detect the width of paper and thereby prevent the printer's interior from being contaminated.

BACKGROUND OF THE INVENTION

In a commonly used inkjet printer, heat applied to ink stored in its head produces bubbles like soap bubbles. The bubbles are ejected through nozzles to form characters on a sheet of printing paper. In this method fonts or figures are represented onto sheets of paper. This mode is also called ink bubble jet because it uses bubbles.

Such a printer usually uses about 64 nozzles. Its form of font can be downloaded by a program, and photographs or figures can be also printed. The resolution of fonts or figures in the inkjet printer is generally 360 DPI (dot per inch). Depending upon the kind of head installed, color printing is available.

A general construction of the inkjet printer has a carrier supported on a main frame and moving left and right by a time belt along a belt pulley, a head mounted on the carrier and moving therewith for ejecting ink, nozzles installed in the head and through which ink is ejected in a predetermined form, a plate rotatably installed on the main frame for carrying paper and simultaneously supporting it during printing, a pressing board fixed to the main frame for making the paper tightly contact the plate, and a wiper/cap for washing or closing the nozzles according to a cleaning signal in a predetermined interval during printing. This kind of conventional inkjet printer is explained below with reference to the attached drawings.

Referring to FIG. 1 schematically showing the inkjet printer, there are included a paper feeding portion or section 2 where paper sheets 1 are stored, a feeding roller 3 for supplying paper sheets 1 stored in paper feeding portion or section 2 for printing, a carrier 4 reciprocating to print on paper sheets 1 supplied by feeding roller 3, a shaft 5 for guiding the reciprocation of carrier 4, a head 6 guided by shaft 5 and mounted on reciprocating carrier 4 for ejecting ink with heat applied, an ink absorbing sponge 7 for cleaning the back side of the paper sheet not printed after its front side is printed with the ink ejected from head 6, and a conveying roller 8 for discharging paper sheet 1 passing through ink absorbing sponge 7. The operation of the above constructed inkjet printer is described below.

First of all, in order to output contents handled by a user via a personal computer (PC) (not shown) using the inkjet printer, paper sheets 1 are stored in paper feeding portion 2 of the inkjet printer. After the storage of paper, the user applies a printing command to the printer via the PC. Receiving the command, the inkjet printer rotates feeding roller 3 counterclockwise so that the leading end la of paper is carried to the bottom of nozzles of head 3.

Ink bubbles ejected from head 6 mounted on carrier 4 reciprocating along shaft 5 are attached to printing paper sheet 1 conveyed. Printing is performed by attaching the ink bubbles onto printing paper 1. Here, in order to prevent the lower portion of the inkjet printer from being contaminated when printing is carried out on an area surpassing the width of printing paper 1, rapidly drying ink is used. In an inkjet printer using such ink, the contamination source for the printer's backside is hard to fully eliminate because the ink is not removed.

For this reason, ink absorbing sponge 7 is mounted to remove the contamination caused due to printing exceeding the paper width. This ink absorbing sponge 7 absorbs and cleans ink surpassing the width of paper 1. Paper 1 completing the printing through the procedure comes out through feeding roller 8 in the direction of the arrow indicated in FIG. 1.

However, the ink absorbing sponge has a limited amount of absorption, and the material is for special use, increasing the production cost of the printer. In addition, printing beyond the width of paper unnecessarily consumes a great amount of ink.

SUMMARY OF THE INVENTION

Therefore, in order to overcome such drawbacks of the prior art, an objective of the present invention is to provide a paper width detecting apparatus and method for an inkjet printer in which a photosensor is mounted on a carrier to detect the width of printing paper so that printing is prevented on an area surpassing the width of paper.

Another objective of the present invention is to provide a paper width detecting apparatus and method for reducing the amount of ink consumed, by preventing printing over the width of the to paper.

Preferably, there is provided a paper width detecting apparatus and method for an inkjet printer including a right paper support integrally formed with a right home position detecting rib; a paper feeding portion for receiving paper sheets and supplying them for printing with the left paper guide movable left and right to tightly fix the paper at the reference of the right paper support; a paper feeding roller for supplying the paper sheets received from the paper feeding portion; a carrier that reciprocates for printing on the paper sheets supplied through the rotation of the paper feeding roller; a photosensor for detecting a light signal output from a light emitting device mounted on the left paper end detecting rib for determining a paper width.

Also, alternatively, there is provided a paper width detecting apparatus and method for an inkjet printer including a right paper support integrally formed with a right home position detecting rib having a first light emitting device; a paper feeding portion for receiving paper sheets and supplying them for printing with the left paper guide movable left and right to tightly fix the paper at the reference of the right paper support; a paper feeding roller for supplying the paper sheets received from the paper feeding portion; a carrier that reciprocates for printing on the paper sheets supplied through the rotation of the paper feeding roller; a photosensor for detecting a light signal output from the second light emitting device mounted on the left paper end detecting rib and a light signal emitted from the first light emitting device mounted on the right home position detecting rib.

BRIEF DESCRIPTION OF THE ATTACHED DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE PREFERRED EMBODIMENT

Hereinafter, embodiments of the present invention will be described with reference to the attached drawings.

Figure 1:
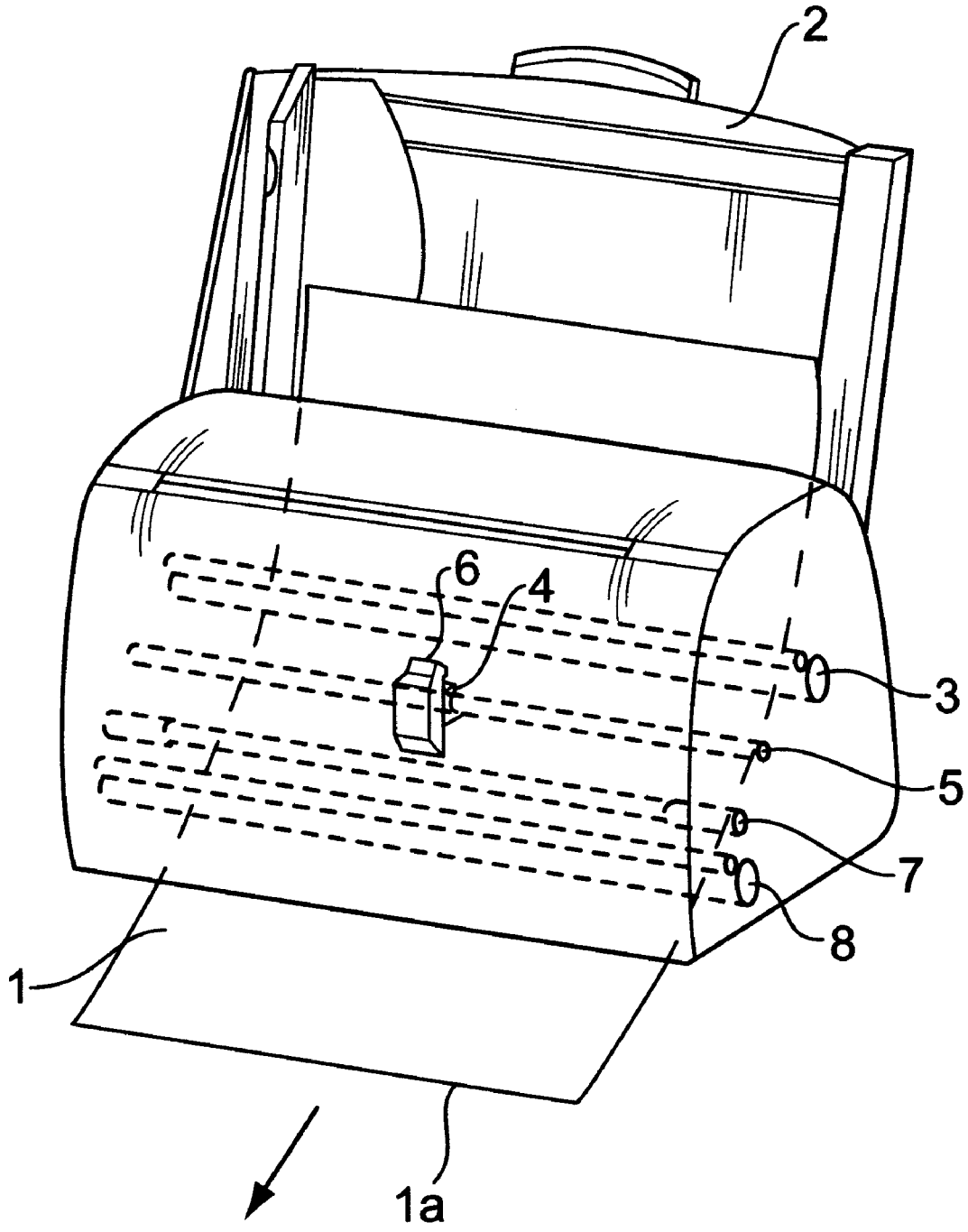
FIG. 1 is a sectional view of a conventional inkjet printer.
Figure 2A:
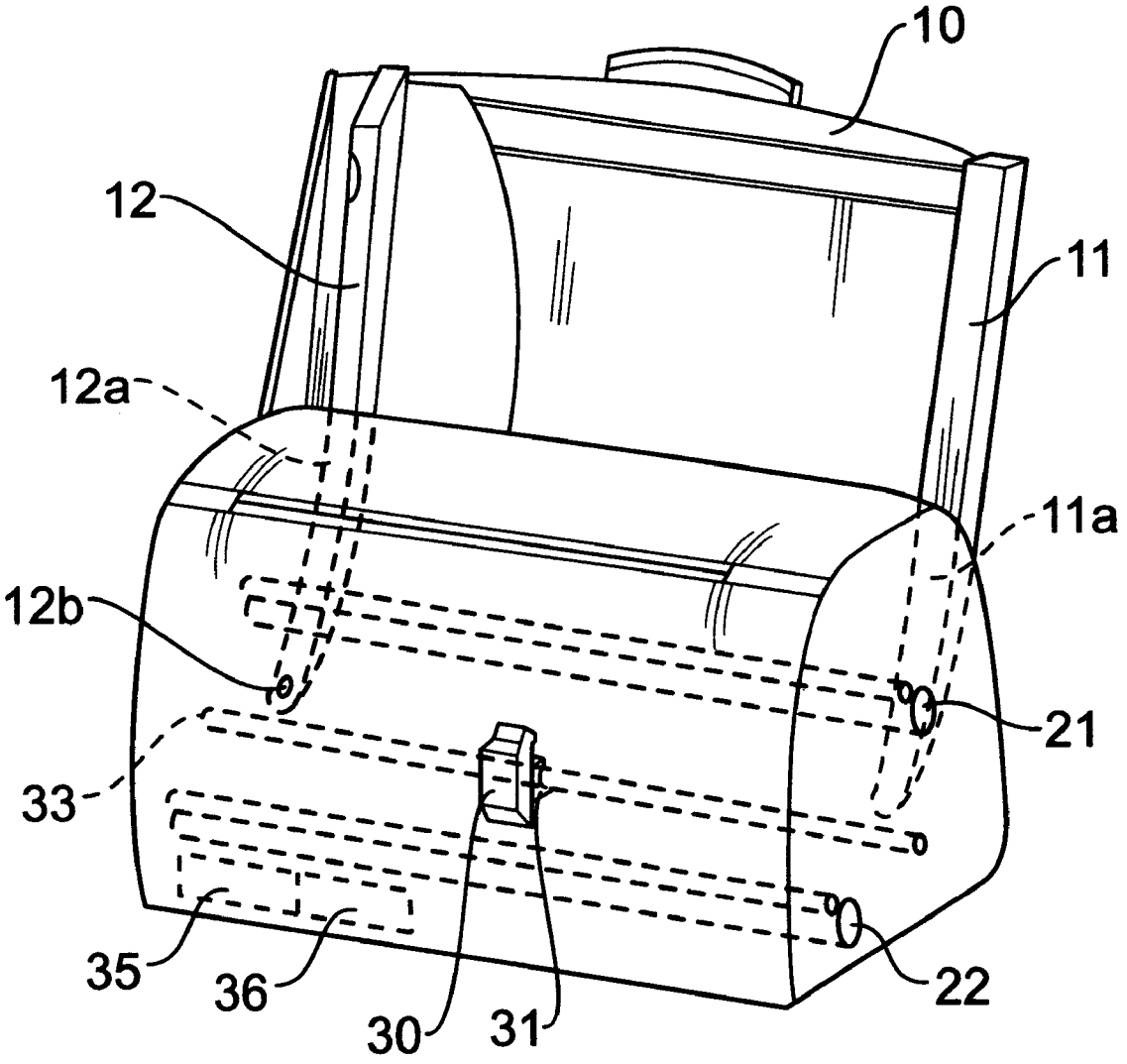
FIG. 2A is a schematic view of a preferred embodiment of an inkjet printer with a paper width detecting device mounted according to the present invention.
Figure 3A:
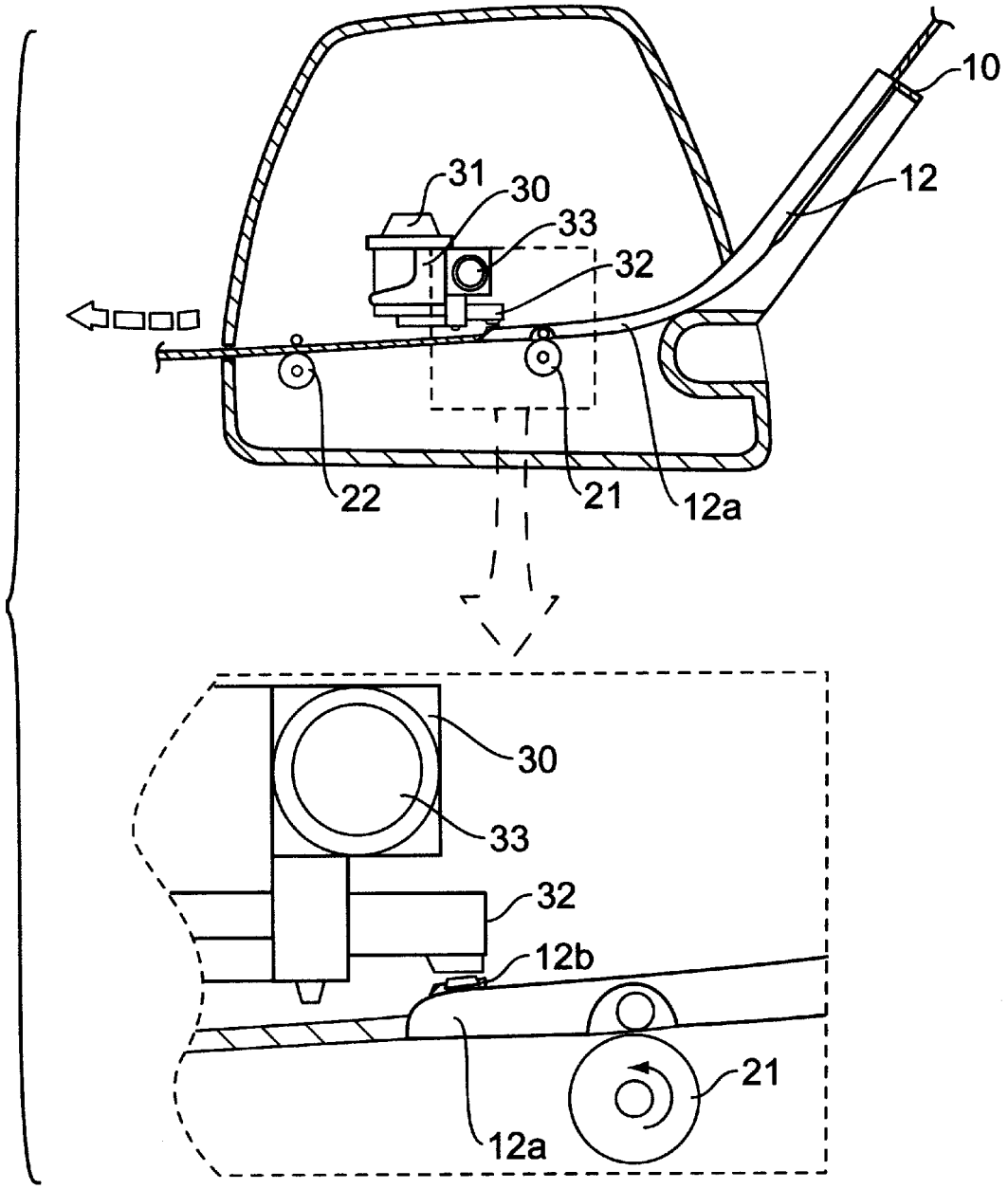
FIG. 3A is a sectional view of the inkjet printer shown in FIG. 2A.

Referring to FIGS. 2A and 3A, an inkjet printer having a paper width detecting device of the present invention comprises a right paper support 11 integrally formed with a right home position detecting rib 11*a*, the right paper support providing a reference being a home position, a left paper guide 12, at one leading end of the left paper guide being integrally formed with a left paper end detecting rib 12*a* having a light emitting device 12*b*, a paper feeding portion or section 10 for receiving paper sheets and supplying them to the inkjet printer with left paper guide 12 movable left and right to tightly fix paper at the reference of right paper support 11, a paper feeding roller 21 for supplying the paper sheets received from paper feeding portion or section 10, a carrier 30 that reciprocates for printing on the paper sheets supplied through the rotation of paper feeding roller 21, a photosensor 32 for detecting a light signal output from light emitting device 12*b* mounted on left paper end detecting rib 12*a*, a shaft 33 for guiding the reciprocation of carrier 30 having photosensor 32, a head 31 mounted on carrier 30 reciprocating by shaft 33 and for ejecting ink, and a conveyor roller 22 that rotates to discharge paper sheets when printing is performed thereon with the ink ejected from head 31.

Figure 2B:
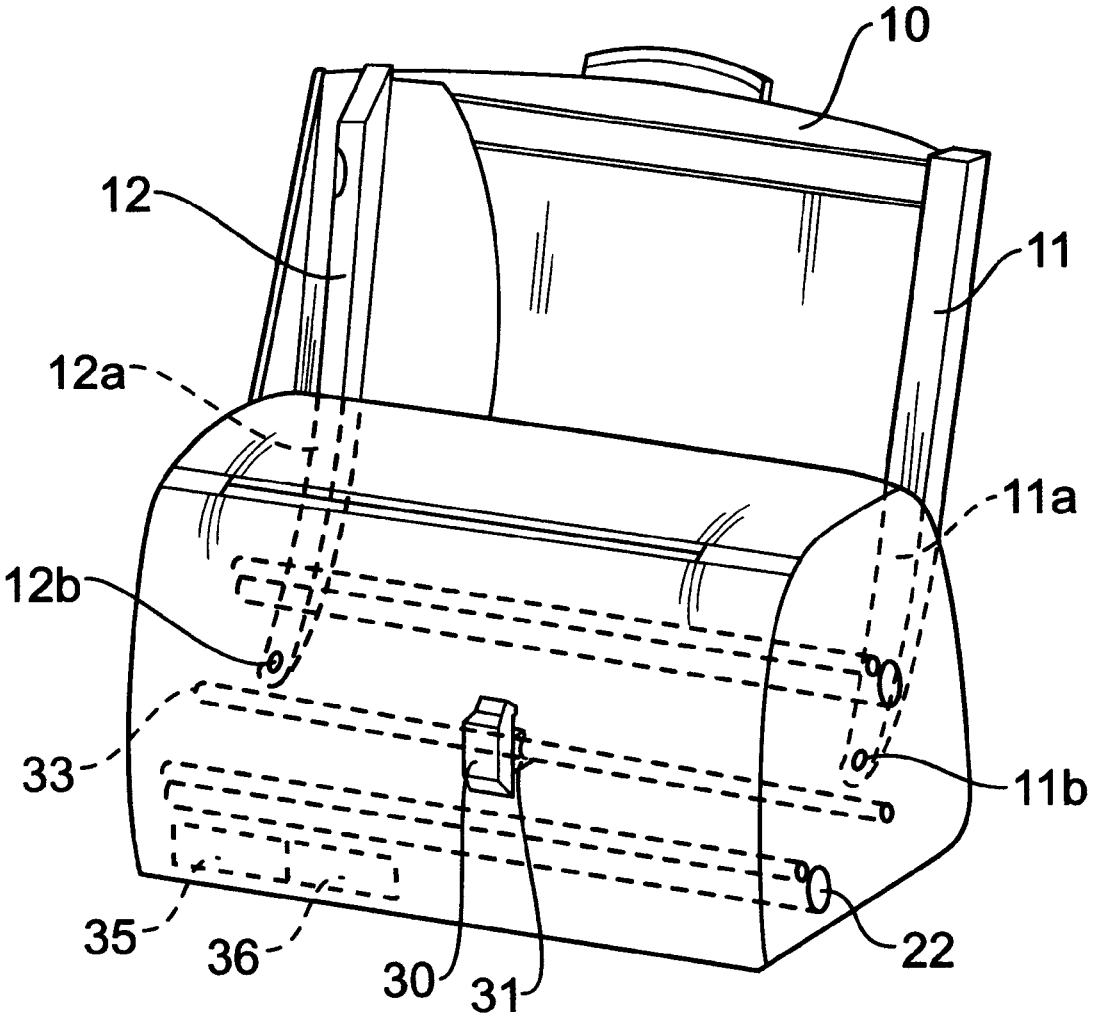
FIG. 2B is a schematic view of an alternative embodiment of an inkjet printer with a paper width detecting device mounted according to the present invention.
Figure 3B:
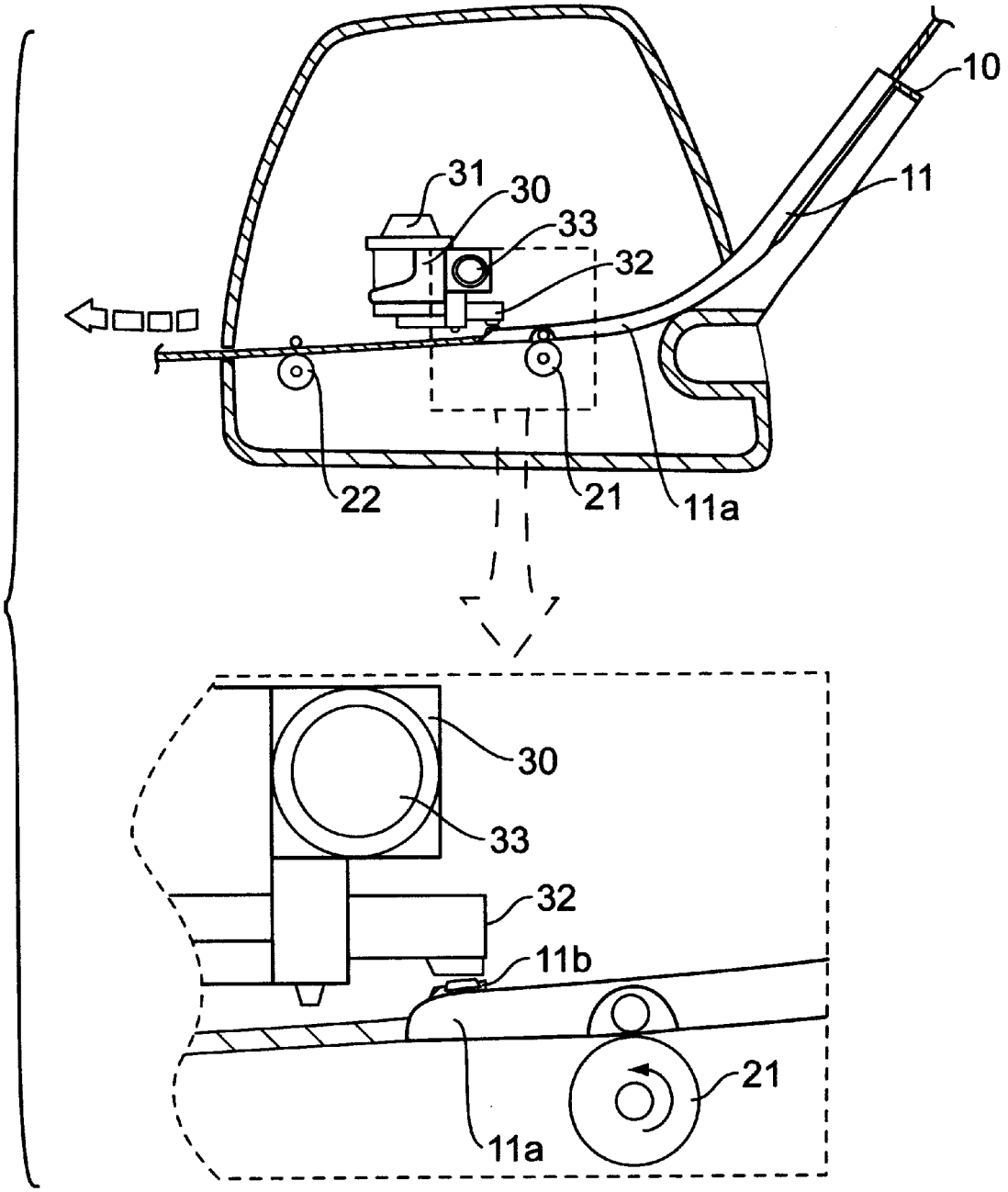
FIG. 3B is a sectional view of the inkjet printer shown in FIG. 2B.

Alternatively, referring to FIGS. 2B and 3B, an inkjet printer having a paper width detecting device of the present invention comprises a right paper support 11 integrally formed with a right home position detecting rib 11*a*, having a first light emitting device 11*b*, the right paper support providing a reference being a home position, a left paper guide 12, at one leading end of the left paper guide being integrally formed with a left paper end detecting rib 12*a* having a second light emitting device 12*b*, a paper feeding portion or section 10 for receiving paper sheets and supplying them to the inkjet printer with left paper guide 12 movable left and right to tightly fix paper at the reference of right paper support 11, a paper feeding roller 21 for supplying the paper sheets received from paper feeding portion or section 10, a carrier 30 that reciprocates for printing on the paper sheets supplied through the rotation of paper feeding roller 21, a photosensor 32 for detecting a light signal output from second light emitting device 12*b* mounted on left paper end detecting rib 12*a* and a light signal applied from first light emitting device lib mounted on right home position detecting rib 11*a*, a shaft 33 for guiding the reciprocation of carrier 30 having photosensor 32, a head 31 mounted on carrier 30 reciprocating by shaft 33 and for ejecting ink, and a conveyor roller 22 that rotates to discharge paper sheets when printing is performed thereon with the ink ejected from head 31.

The operations of detecting the width of paper in the respective embodiments of FIGS. 2A, 3A and FIGS. 2B, 3B will be explained below.

In the embodiment of FIGS. 2A, 3A, when a user applies a printing command to an inkjet printer through a PC (not shown), paper feeding roller 21 rotates according to the printing command applied. When the roller rotates, the leading edge of a paper sheet on paper feeding portion or section 10 is placed on the bottom of the nozzle plate of head 31.

Here, the user puts the paper sheet on paper feeding portion or section 10 at the reference of right paper support 11. Using left paper guide 12 movable to the left and right, the paper sheet placed on paper feeding portion or section 10 is completely and tightly pressed. This situation makes light emitting device 12*b* mounted on the leading edge of left paper detecting rib 12*a* integrally formed on one leading end of left paper guide 12 illuminate.

Carrier 30 moves leftwise along shaft 33 and then the photosensor 32 detects the light emitted from light emitting device 12*b* mounted on the leading end of left paper end detecting rib 12*a*. When photosensor 32 mounted on carrier 30 detects the light generated from light emitting device 12*b*, a current is generated. Specifically, a distance is measured by the photosensor 32 detecting the light produced by the light emitting device 12*b*. A distance calculation is performed, based upon the light of the light emitting device 12*b* sensed by the photosensor 32 with reference to the reference position or home position of the right home position detecting rib 11*a*, with a distance calculation program previously stored in a microcomputer 35 in the driving circuit printed circuit board (PCB) 36 built in the inkjet printer.

When the distance calculation is completed, ink bubbles are ejected from the nozzles of head 31 mounted on carrier 30. The ink bubbles are applied to the paper sheet as much as its width previously calculated, preventing printing exceeding the width of the paper sheet. The printed paper is discharged through the rotation force of conveyor roller 22.

The position of photosensor 32 that senses the light emitted from light emitting device 12*b* is described referring to FIGS. 2A and 3A. Referring to FIGS. 2A and 3A, paper feeding portion or section 10 accepts paper sheets as shown in the drawing FIGS. 2A and 3A. Here, left paper guide 12 having left detecting rib 12*a* integrally formed with left paper guide 12 having light emitting device 12*b* is placed so light emitting device 12*b* is positioned toward the bottom of the detection area of photosensor 32 mounted on carrier 30. The height of photosensor 32 is controlled so that the distance is maintained before the light spreads when the light emitting device 12*b* mounted on the leading end of left detecting rib 12*a* illuminates.

Figure 4A:
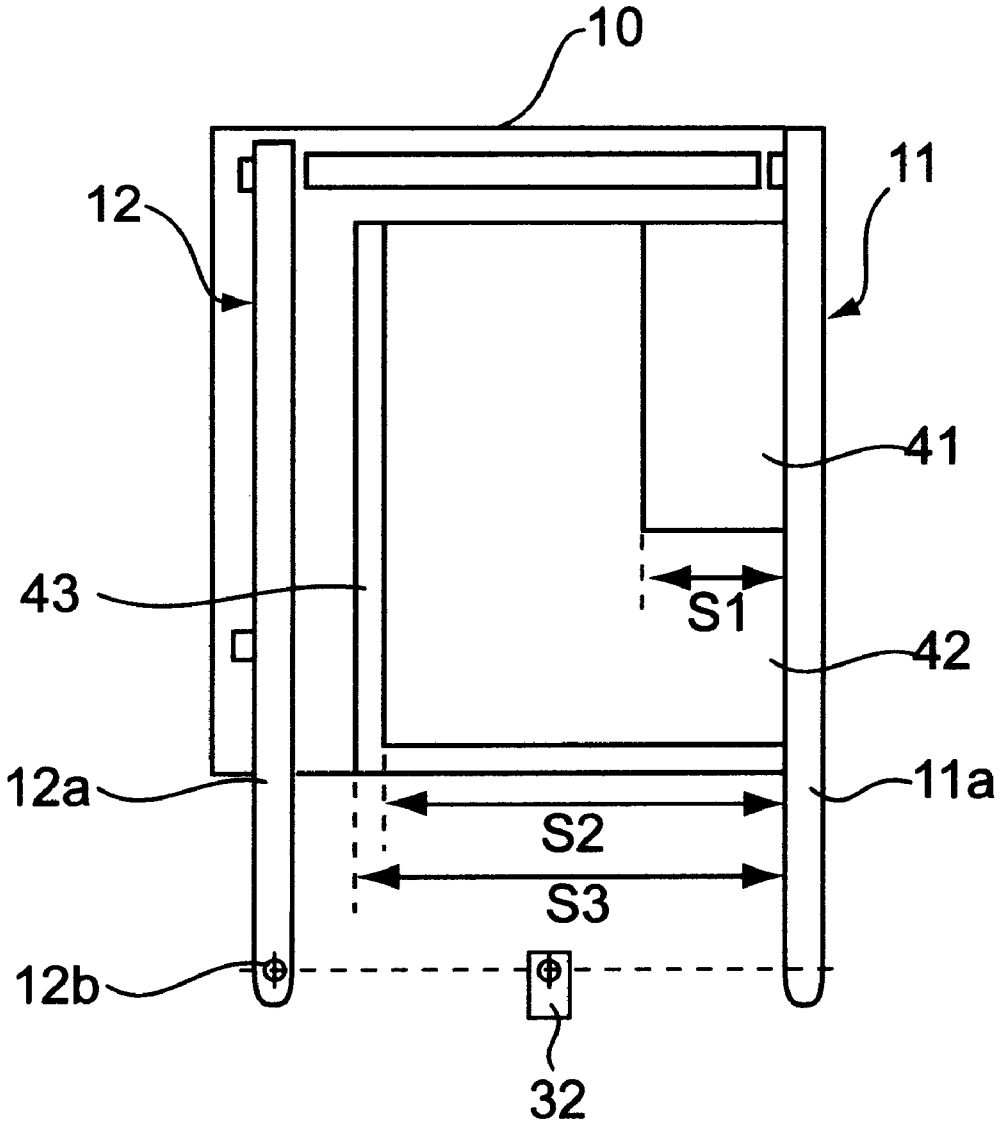
FIG. 4A is a diagram of showing a method of detecting the width of paper using the embodiment of FIG. 2A.

A procedure of detecting the width of various kinds of paper using photosensor 32 will now be explained for the embodiment of FIG. 2A, referring to FIG. 4A. FIG. 4A shows several kinds of paper put on paper feeding portion or section 10. First, in case of envelope 41, placed at the reference of right home position detecting rib 11*a* integrally formed with right paper support 11, left paper end detecting rib 12*a* integrally formed with left paper guide 12 moves rightwise to come into close contact with the envelope 41 so that the left and right detecting ribs 12*a* and 11*a* are spaced apart by the envelope width S1. When the left paper guide 12 makes tight contact with envelope 41, the light emitting device 12*b* mounted on the leading end of left paper end detecting rib 12*a* illuminates. The light is sensed by photosensor 32, which calculates the width of envelope 41. For A4 size paper 42 and letter size paper 43, the same procedure is performed to calculate their respective widths S2 and S3.

Now referring to the alternative embodiment of FIGS. 2B and 3B, when a user applies a printing command to an inkjet printer through a PC (not shown), paper feeding roller 21 rotates according to the printing command applied. When the roller rotates, the leading edge of a paper sheet on paper feeding portion or section 10 is placed on the bottom of the nozzle plate of head 31.

Here, the user puts the paper sheet on paper feeding portion or section 10 at the reference of right paper support 11. In this state, first light emitting device 11*b* illuminates while mounted on the leading end of right home position detecting rib 11*a* extending up to the bottom of the nozzle plate of head 31 at one leading end of right paper support 11. The light emitted is detected by photosensor 32 placed directly above the first light emitting device 11*b*.

Meanwhile, using left paper guide 12 movable to the left and right, the paper sheet placed on paper feeding portion or section 10 is completely and tightly pressed. This situation makes second light emitting device 12*b* mounted on the leading edge of the left paper end detecting rib 12*a* integrally formed on one leading end of left paper guide 12 illuminate.

After photosensor 32 detects the position of the reference or home position mounted on the leading edge of the right home position detecting rib 11*a*, carrier 30 moves leftwise along shaft 33 and then the photosensor 32 detects the light emitted from second light emitting device 12*b* mounted on the leading end of left paper end detecting rib 12*a*. This procedure is carried out in the same way as when the light from the first light emitting device 11*b* mounted on the leading end of right home position detecting rib 11*a*, is detected.

When photosensor 32 mounted on carrier 30 detects the light generated from the first light emitting device 11*b* and the second light emitting device 12*b*, a current is generated. Specifically, a distance is measured while carrier 30 returns leftwise to detect the light produced from second light emitting device 12*b* mounted on the leading end of left paper end detecting rib 12*a* from the reference of the light produced from the first light emitting device 11*b* mounted on the leading end of right home position detecting rib 11*a*.

For instance, when photosensor 32 senses the light produced by first light emitting device 11*b* from the reference or home position, the distance until the light from the second light emitting device 12*b* is detected is calculated from the light sensed from the reference or home position. This distance calculation is performed with a distance calculation program previously stored in a microcomputer 35 in the driving circuit printed circuit board (PCB) 36 built in the inkjet printer.

When the distance calculation is completed, ink bubbles are ejected from the nozzles of head mounted on carrier 30. The ink bubbles are applied to the paper sheet as much as its width previously calculated, preventing printing exceeding the width of the paper sheet. The printed paper is discharged through the rotation force of conveyor roller 22.

The position of photosensor 32 that senses the light emitted in the alternative embodiment of FIG. 2B is described below in more detail, referring to FIGS. 2B and 3B. Referring to FIGS. 2B and 13B, paper feeding portion or section 10 accepts paper sheets as shown in the drawing. Here, right paper support 11 is used as the reference or home position for a paper sheet to be printed when right home position detecting rib 11*a* integrally formed with right paper support 11 is placed toward the bottom of the detection area of photosensor 32 mounted on carrier 30. The height of photosensor 32 is controlled so that the distance is maintained before the light spreads when the first light emitting device 11*b* mounted on the leading end of right home position detecting rib 11*a* illuminates.

Figure 4B:
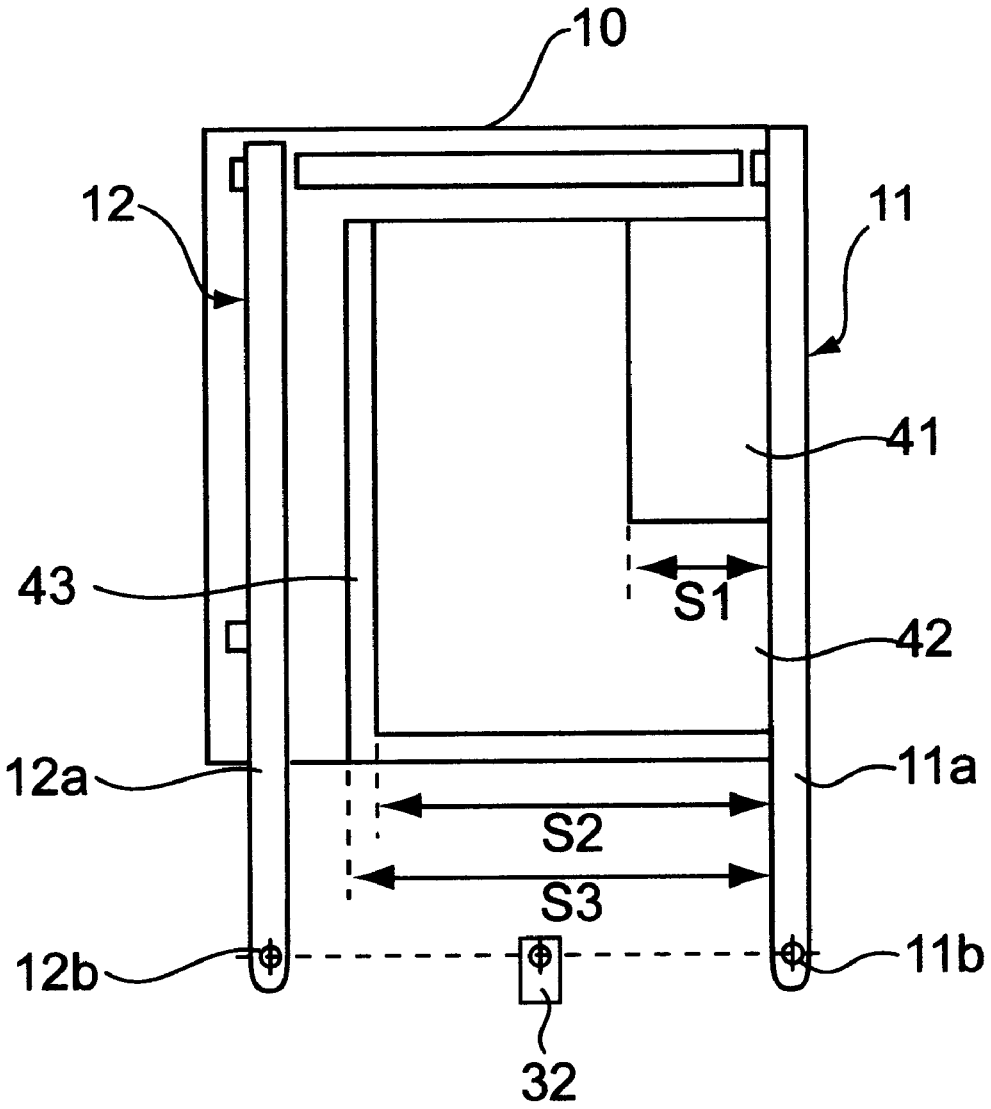
FIG. 4B is a diagram having a method of detecting the width of paper according to the embodiment of FIG. 2B.

A procedure of detecting the width of various kinds of paper using photosensor 32 will now be explained in the alternative embodiment of FIG. 2B, with reference to FIG. 4B. FIG. 4B shows several kinds of paper put on paper feeding portion or section 10. First, in case of envelope 41, placed at the reference of right home position detecting rib 11*a* integrally formed with right paper support 11, left paper end detecting rib 12*a* integrally formed with left paper guide 12 moves rightwise to come into close contact with the envelope 41 so that the left and right detecting ribs 12*a* and 11*a* are spaced apart by the envelope width S1. When the left paper guide 12 makes tight contact with envelope 41, the first light emitting device 11*b* mounted on the leading end of right home position detecting rib 11*a*, illuminates. In addition, the second light emitting device 12*b* mounted on the leading end of left paper end detecting rib 12*a* illuminates. The light is sensed by photosensor 32, which calculates the width of envelope 41. For A4 size paper 42 and letter size paper 43, the same procedure is performed to calculate their respective widths S2 and S3.

Figure 5:
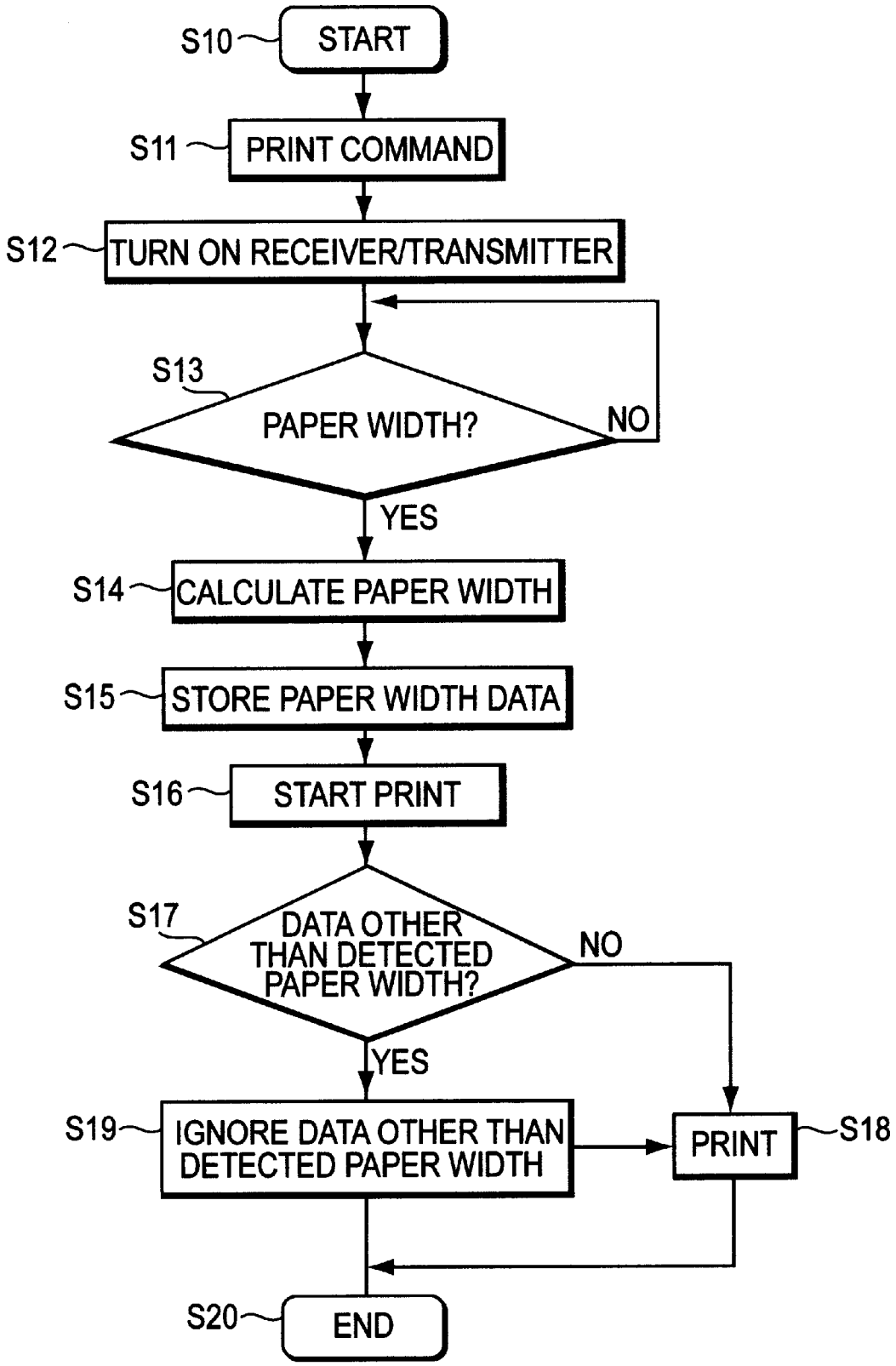
FIG. 5 is a flowchart of showing a method of detecting the width of paper according to the present invention.

A procedure for calculating the width of printing paper and then printing on the paper is explained with reference to FIG. 5. Referring to FIG. 5, a method of detecting the width of paper according to the present invention comprises the steps of:

Starting in step S10 for paper width detection; deciding in step S11 whether a print command is input or not; returning to the initial position in the print command detection step S11 when the print command is not sensed; moving in step S13 the head 31 and photosensor 32 left and right when the print command is detected in the step S11; and deciding in step S12 whether the leftmost light emitting device 12*b* is turned on or not while head 31 and photosensor 32 moves leftwise in step S13; returning the head 31 and photosensor 32 to an initial position in step S13 when the light emitting device 12*b* is not ON; returning leftwise in step S13 the head 31 and photosensor 32 when the light emitting device 12*b* is ON; calculating in step S14 a printing area (paper width data) when head 31 and photosensor 32 returns leftwise in step S13; recognizing and storing in step S15 the printing area (paper width data) when it is calculated in step S14; starting printing in step S16 when the printing area (paper width data) is recognized and stored in step S15; deciding in step S17 whether there is other data than the printing area (paper width data) or not when printing starts in step S16; performing printing when there is no other data than the printing area (paper width data) in step S18; ignoring in step S19 other data than the printing area (paper width data) if it is present in step S17; and ending at step S20 when printing is completed.

When head 31 and photosensor 32 completely moves in step S13, it is decided in step S12 if leftmost light emitting device 12*b* becomes ON. If the light emitting device 12*b* that measures the distance of the left reference of the printing paper is not ON, the head 31 and photosensor 32 returns to the position of printing paper reference in step S13 and the home position of the printing paper is reconfirmed. Conversely, if the left light emitting device 12*b* becomes ON, the head 31 and photosensor 32 returns moving from the home position in step S13. When the head completely returns, the width of the printing paper is detected. In step S14, the width of the printing paper is calculated. Then the calculated width of printing paper is stored in step S15 in an NVRAM built in the driving circuit 36.

When after the width of printing paper is determined in step S14, printing is performed in step S16. In step S17 it is determined if there is other data than printing area (paper width data). If there is no other data according to the result, printing is carried out according to the printing data applied to the inkjet printer in step S18.

If there is other data than the printing area (paper width data), step S18 is performed to print regardless of it. When printing is finished with the paper width detected, step S20 is performed for the end.

As described above, the present invention previously interrupts ink from being printed on the back of paper, eliminating the contamination of the interior of an inkjet printer.

While there have been illustrated and described what are considered to be preferred embodiments of the present invention, it will be understood by those skilled in the art that various changes and modifications may be made, and equivalents may be substituted for elements thereof without departing from the true scope of the present invention. In addition, many modifications may be made to adapt a particular situation to the teaching of the present invention without departing from the scope thereof. Therefore, it is intended that the present invention not be limited to the particular embodiments disclosed as the best mode contemplated for carrying out the present invention, but that the present invention includes all embodiments falling within the scope of the appended claims.

What is claimed is:

1. A paper width detecting apparatus for an inkjet printer, comprising:

a right paper support integrally formed with a right home position detecting rib, the right paper support being a home position reference of a paper sheet for printing;

a left paper guide integrally formed with a left paper end detecting rib, the left paper end detecting rib having a light emitting device;

a paper feeding section for receiving at least one paper sheet and for supplying the at least one paper sheet for printing with the left paper guide movable in a left direction and in a right a direction to tightly fix the at least one paper sheet at the home position reference of the right paper support;

a paper feeding roller for supplying for printing the at least one paper sheet received from the paper feeding section;

a carrier that reciprocates for printing on the at least one paper sheet supplied for printing through the rotation of the paper feeding roller; and a photosensor for detecting a light signal output from the light emitting device mounted on the left paper end detecting rib for determining the paper width of the at least one paper sheet.

2. The paper width detecting apparatus according to claim 1, wherein the light signal output from the light emitting device mounted on the left paper end detecting rib is used for determining a distance corresponding to the paper width of at least one paper sheet supplied for printing.

3. The paper width detecting apparatus according to claim 1, wherein the light signal output from the light emitting device mounted on the left paper end detecting rib is used for determining a distance corresponding to a printing area of the at least one paper sheet supplied for printing.

4. The paper width detecting apparatus according to claim 1, wherein the photosensor is mounted on the carrier and when said carrier reciprocates a distance is measured determined by the light signal output from the light emitting device.

5. The paper width detecting apparatus according to claim 4, wherein the distance measured corresponds to the paper width of the at least one paper sheet supplied for printing.

6. The paper width detecting apparatus according to claim 4, wherein the distance measured corresponds to a printing area of the at least one paper sheet supplied for printing.

7. A method of detecting a paper width of a paper in an inkjet printer, comprising the steps of:

determining whether a print command is detected for the inkjet printer;

moving a head having a photosensor of the inkjet printer from an initial position in a left direction and then in a right direction when the print command is detected;

determining whether a leftmost light emitting device is turned on while the head moves in the left direction;

moving the head in the left direction from the initial position when the leftmost light emitting device is ON;

calculating a printing area of the paper when the head moves from the initial position to a position of the leftmost light emitting device; and recognizing and storing for the inkjet printer the printing area of the paper when it is calculated.

8. The method as claimed in claim 7, further comprising the step of returning the head to the initial position if the leftmost light emitting device is not ON.

9. The method as claimed in claim 7, further comprising the step of measuring a distance corresponding to the printing area of the paper based upon light output from the leftmost light emitting device with reference to the initial position.

10. The method as claimed in claim 9, wherein the distance measured corresponds to the paper width of the paper.

11. The method as claimed in claim 9, wherein the printing area of the paper corresponds to the paper width of the paper.

12. A method for detecting a paper width of a paper in an inkjet printer, comprising the steps of:

providing a light emitting device in the inkjet printer;

providing a head having a photosensor in the inkjet printer;

moving the head having the photosensor in a left direction from an initial position to a second position to detect by the photosensor a light signal output from the light emitting device located at the second position;

measuring a distance corresponding to the paper width of the paper based upon the detected light signal output from the light emitting device; and determining from the distance measured the paper width of the paper.

13. The method as claimed in claim 12, wherein a printing area of the paper corresponds to the paper width of the paper.

14. A paper width detecting apparatus for an inkjet printer, comprising:

a right paper support integrally formed with a right home position detecting rib, the right home position detecting rib having a first light emitting device, the right paper support being a home position reference of a paper sheet for printing;

a left paper guide integrally formed with a left paper end detecting rib, the left paper end detecting rib having a second light emitting device;

a paper feeding section for receiving at least one paper sheet and for supplying the at least one paper sheet for printing with the left paper guide movable in a left direction and in a right direction to tightly fix the at least one paper sheet at the home position reference of the right paper support;

a paper feeding roller for supplying for printing the at least one paper sheet received from the paper feeding section;

a carrier that reciprocates for printing on the at least one paper sheet supplied for printing through the rotation of the paper feeding roller; and a photosensor for detecting a light signal output from the second light emitting device mounted on the left paper end detecting rib and for detecting a light signal output from the first light emitting device mounted on the right home position detecting rib for determining the paper width of the at least one paper sheet.

15. A method for detecting a paper width of a paper in an inkjet printer, comprising the steps of:

providing a first light emitting device and a second light emitting device in the inkjet printer, the first light emitting device being spaced in opposing relation to the second light emitting device;

providing a head having a photosensor in the inkjet printer;

moving the head having the photosensor in a left direction from an initial position to detect by the photosensor a light signal output from the second light emitting device and a light signal output from the first light emitting device;

measuring a distance corresponding to the paper width of the paper based upon the detected light signal output from the second light emitting device and the detected light signal output from the first light emitting device; and determining from the distance measured the paper width of the paper.

16. The method as claimed in claim 15, wherein a printing area of the paper corresponds to the paper width of the paper.

* * * * *